US006349939B1

(12) United States Patent
Tsai

(10) Patent No.: US 6,349,939 B1
(45) Date of Patent: Feb. 26, 2002

(54) GAME TABLE WITH TABLE BODY OVERLAID ON AND CONNECTED WITH TABLE FRAME

(76) Inventor: Lore Tsai, No. 22, Lane 20, Zichiang Street, East Area, Taichung City (TW)

( * ) Notice: Subject to any disclaimer, the term of this patent is extended or adjusted under 35 U.S.C. 154(b) by 0 days.

(21) Appl. No.: 09/534,225

(22) Filed: Mar. 24, 2000

(51) Int. Cl.[7] ..... A63F 7/06; A63D 15/04
(52) U.S. Cl. ..... 273/108.1; 273/309; 473/10
(58) Field of Search ..... 273/108.1, 309, 273/284, 287; 108/50.4, 153.1, 159; 473/4, 6, 10

(56) References Cited

U.S. PATENT DOCUMENTS 527,279 A * 10/1894 Green ..... 273/284
2,936,178 A * 5/1960 Sprouse ..... 273/309 X
3,001,843 A * 9/1961 Davis ..... 273/309 X
4,041,880 A * 8/1977 Schankman ..... 273/309 X
4,063,728 A * 12/1977 Zemanek ..... 273/108.1 X
5,630,760 A * 5/1997 Brown et al. ..... 273/108.52
5,752,886 A * 5/1998 Tien ..... 273/108.1 X
6,109,607 A * 8/2000 Cartwright et al. ..... 273/108.1
6,120,030 A * 9/2000 Chou ..... 273/284

* cited by examiner

*Primary Examiner*—Raleigh W. Chiu
(74) *Attorney, Agent, or Firm*—Troxell Law Office PLLC

(57) ABSTRACT

Game table with table body overlaid on and connected with table frame, including: a table frame having a rectangular frame body and a predetermined number of legs connected to the frame body; and at least one table body which is a rectangular frame body with a certain thickness and horizontally positioned. A top and a bottom faces of the table body are respectively disposed with different game patterns. The table body is overlaid on the table frame with any of the faces facing upward. The bottom edge of peripheral frame of the table body is engaged with top edge of the frame body of the table frame, whereby a player can replaceably overlay the table body on the table frame with any of the faces facing upward to provide various kinds of game patterns. The game table further includes a table board which can be horizontally placed on the game table to provide other game patterns.

20 Claims, 12 Drawing Sheets

GAME TABLE WITH TABLE BODY OVERLAID ON AND CONNECTED WITH TABLE FRAME

BACKGROUND OF THE INVENTION

The present invention relates to a game table, and more particularly to a game table in which the table body is replaceably overlaid on and connected with the table frame so as to provide various kinds of games on the same game table.

There are many types of game tables on which a game simulating a sport is played, such as the billiard table, the table for playing table football and the table for playing table hockey. The early game table can only provide one single type of game for the players. That is, the players can only play one single type of game on the game table. Some of the recently developed game tables are convertible for the players to play different kinds of games on the same table.

FIG. 1 shows a convertible game table 10 including a table body 12 and a table board 14. Two plane faces 16, 18 of the table board 14 are manufactured into two different game table faces such as billiards or hockey. When the table board 14 is placed on the table body 12 with the plane face 16 facing upward, in cooperation with the ball bags 13 disposed on the table body, a billiards table is formed. Reversely, when the other plane face 18 of the table board 14 is faced upward, a table of table hockey is formed. Accordingly, one table can be converted for playing two kinds of games.

According to the above arrangement, the table board can be simply placed on the table body to change the game pattern. The table board which can be placed on the table body is limited so that only a few games can be provided. For example, the game table of FIG. 1 can only provide two kinds of game patterns. This can hardly satisfy the requirement of the players. Furthermore, in order to place the table board 14 into the table body, the thickness of the table board is very thin. Therefore, only the hockey or billiards game can be designed on the table board 14, while other games are not suitable. As a result, the change of game pattern is quite limited.

SUMMARY OF THE INVENTION

It is therefore a primary object of the present invention to provide a game table in which the table body is replaceably overlaid on and connected with the table frame so as to provide versatile sport games and enhance the entertaining effect.

It is a further object of the present invention to provide the above game table in which the table body is replaceably overlaid on and connected with the table frame so that various kinds of game patterns can be designed on the table body.

The present invention can be best understood through the following description and accompanying drawings wherein:

DETAILED DESCRIPTION OF THE PREFERRED EMBODIMENTS

Figure 1B:
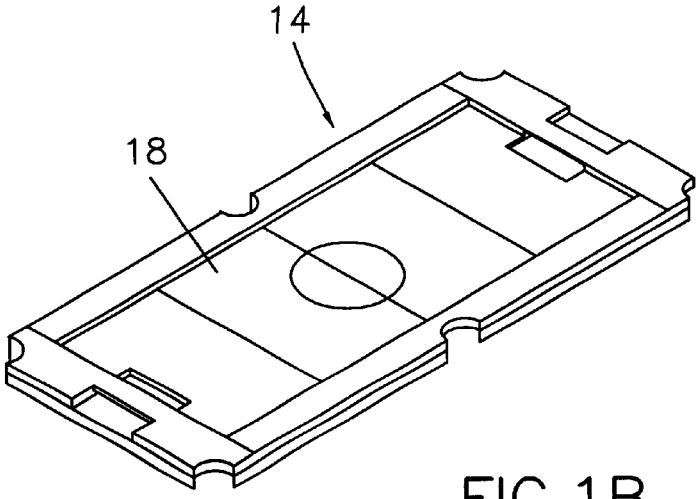
FIG. 1B PRIOR ART
FIG. 1B shows that the other face of the table board of FIG. 1A is faced upward to form another type of game pattern.
Figure 1A:
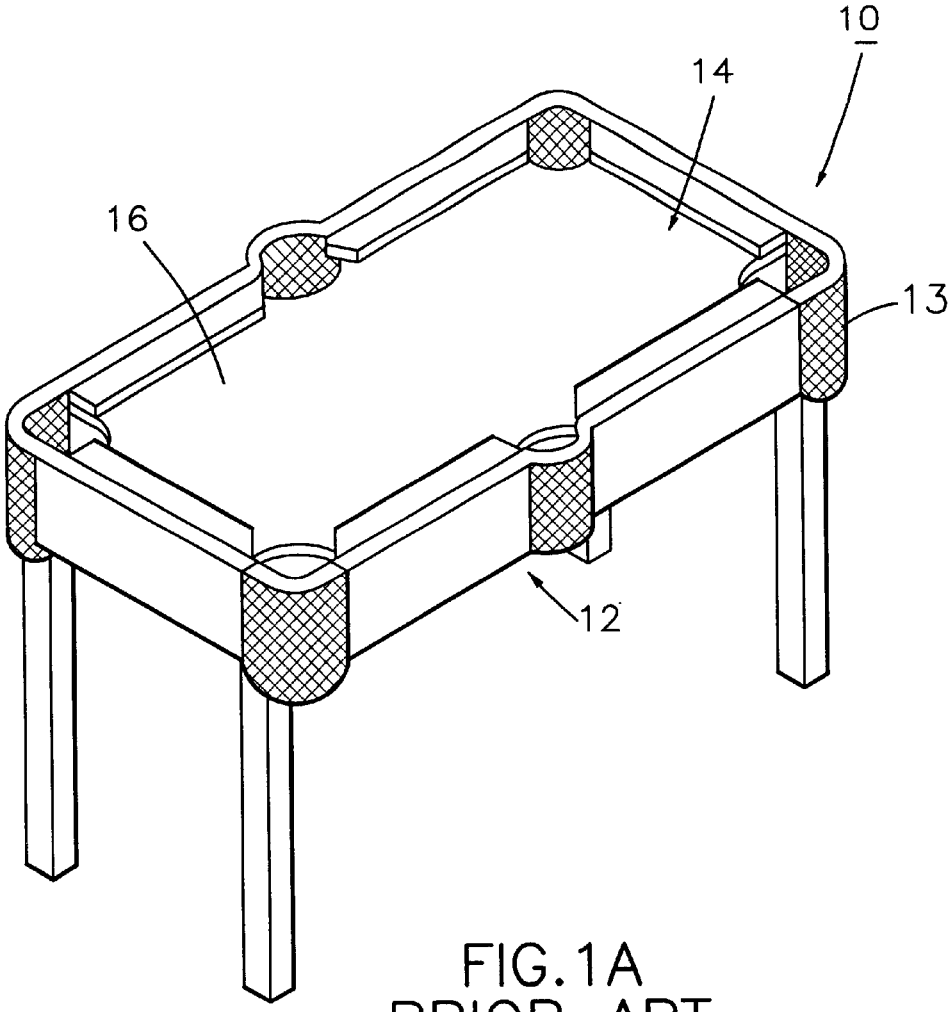
FIG. 1A PRIOR ART
FIG. 1A shows a conventional game table on which a table board is placed with one face facing upward.
Figure 2:
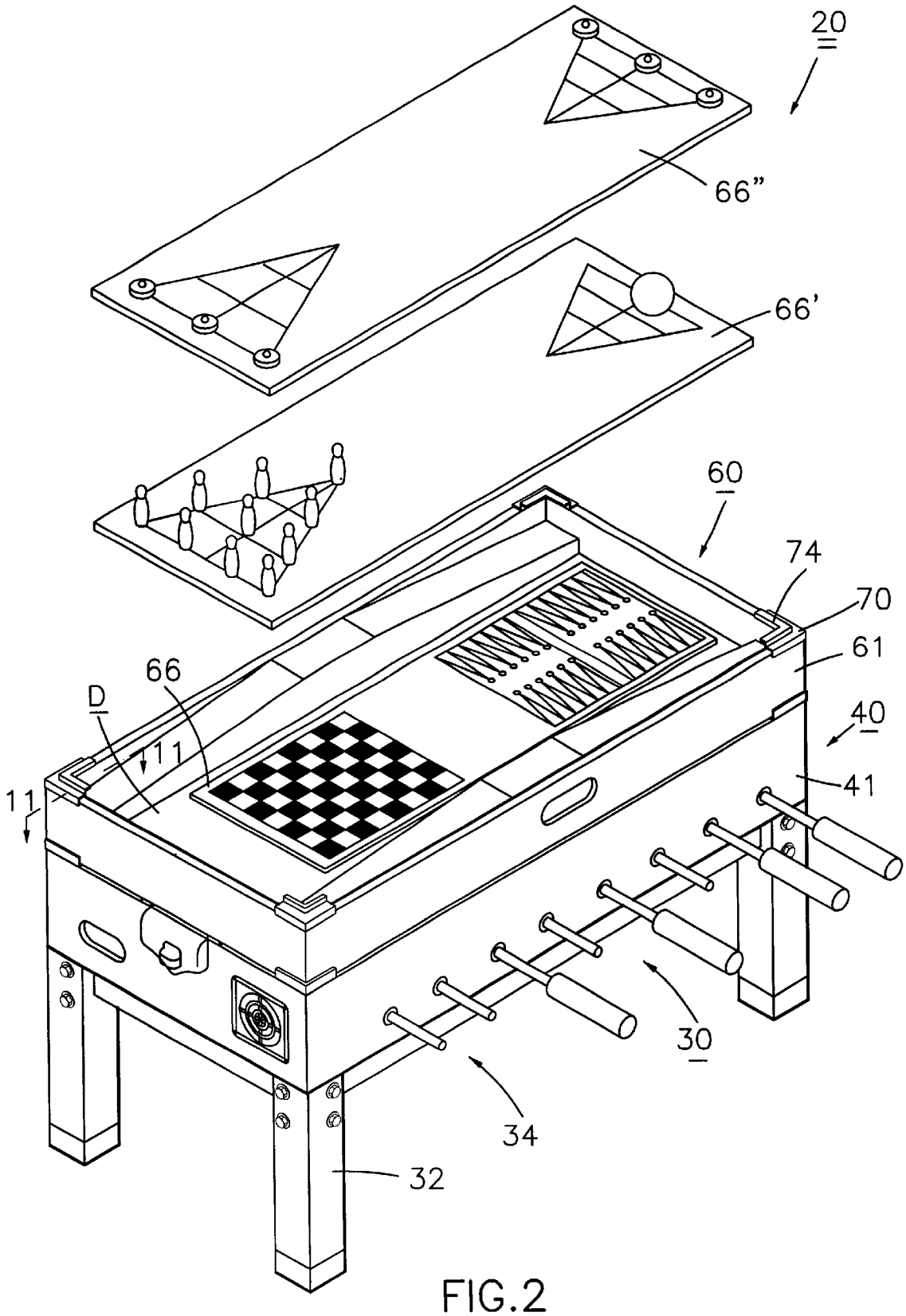
FIG. 2 is a perspective view of an embodiment of the present invention, showing that two table bodies are both overlaid on the table frame.
Figure 12:
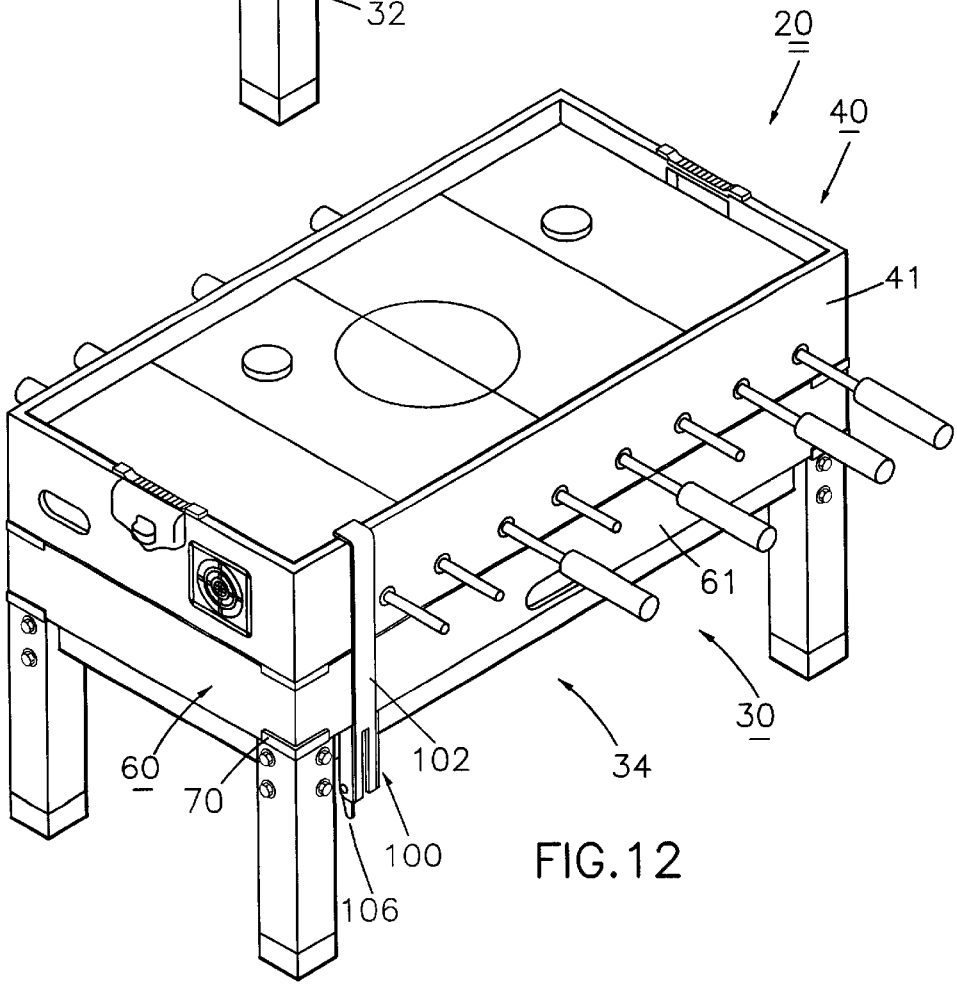
FIG. 12 is a view according to FIG. 2, showing another aspect of the overlapped table bodies.
Figure 13:
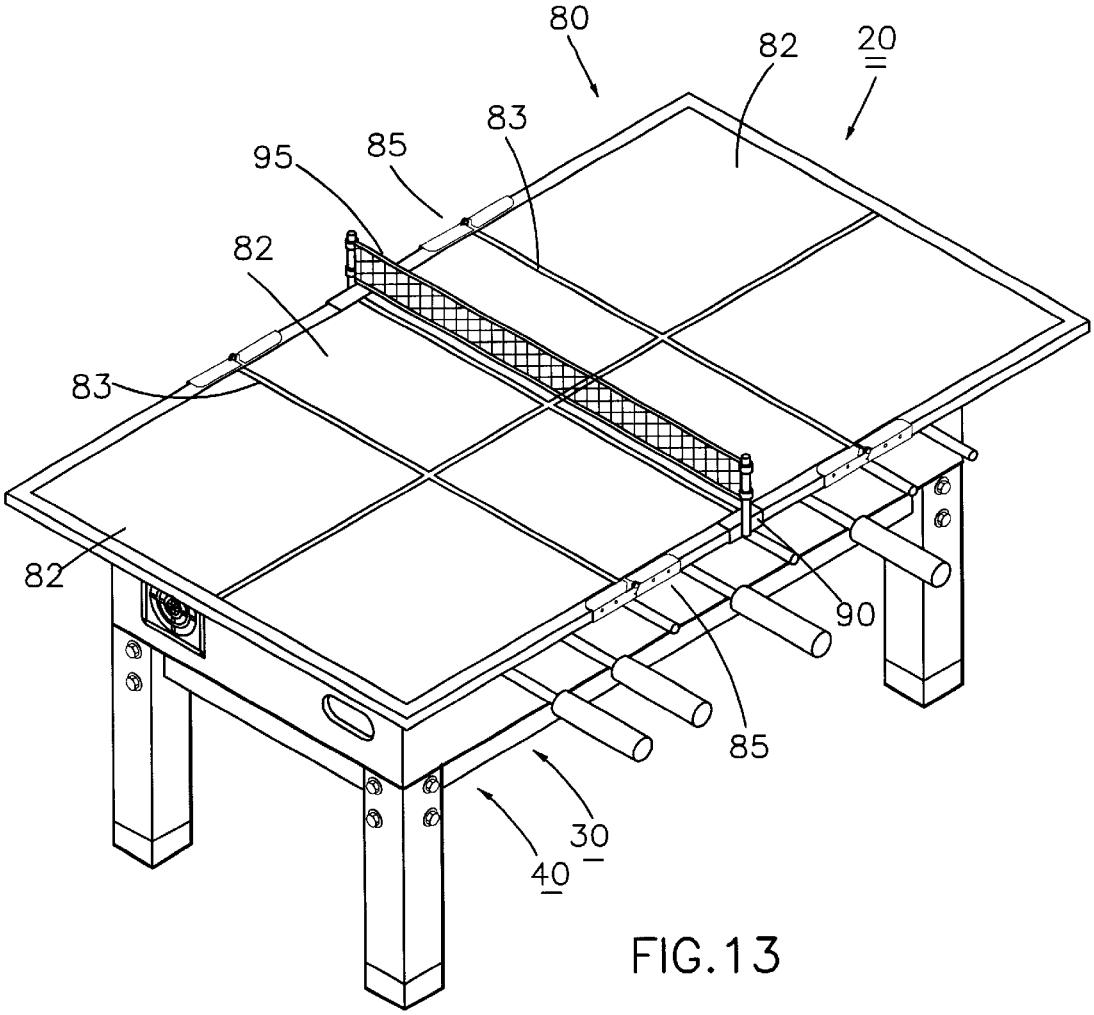
FIG. 13 shows another embodiment of the present invention, showing a using state of table tennis.

The game table 20 of the present invention includes a table frame 30 and two table bodies 40, 60. The peripheries of the table frame 30 and the table bodies 40, 60 can be snugly engaged with each other, whereby the two table bodies can be overlapped and then placed on the table frame 30 as shown in FIGS. 2 and 12. Alternatively, the table bodies can be respectively overlaid on the table frame as shown in FIGS. 3, 6, 7 and 10. In addition, a table panel 80 can be horizontally placed on the table frame 30 as shown in FIG. 13 so as to convert the game table for multiple games.

Figure 4:
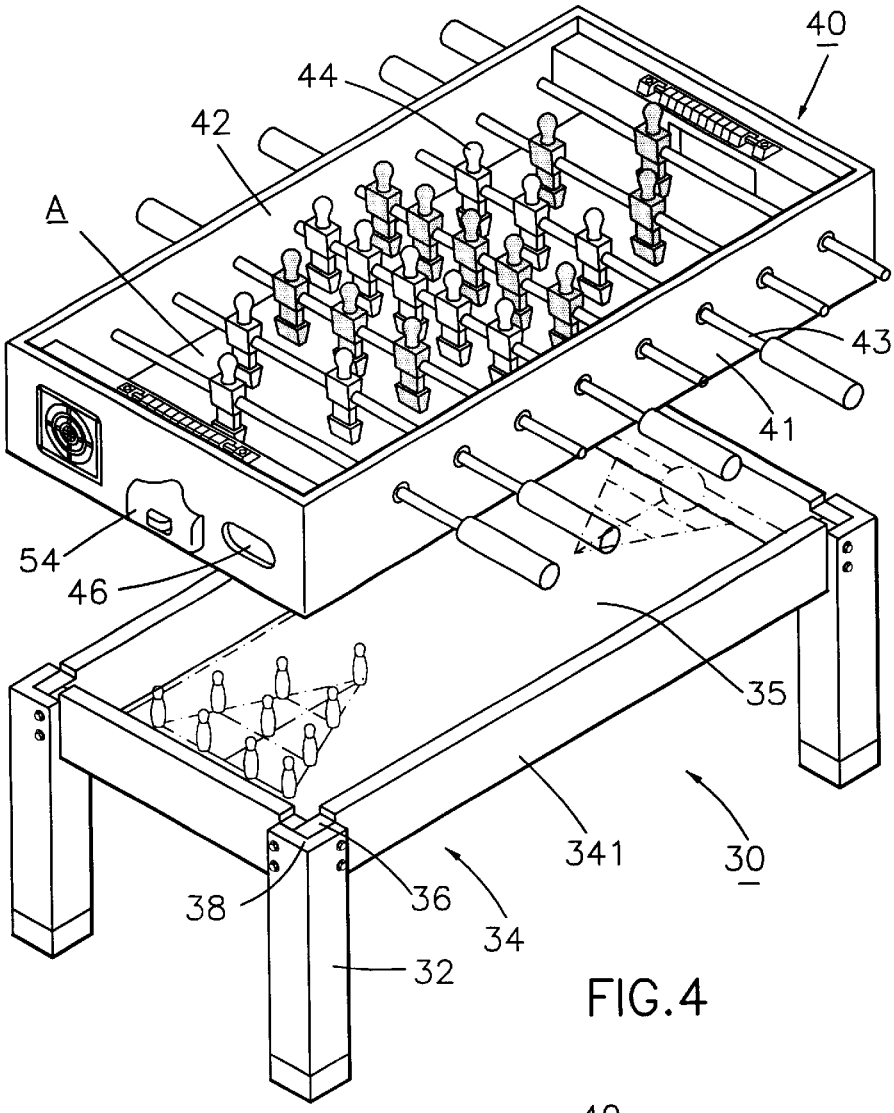
FIG. 4 is a perspective exploded and partially sectional view according to FIG. 3.

Referring to FIG. 4, the table frame 30 is composed of four legs 32 and four slats which form a rectangular frame body 34. The frame body 34 has a inward recessed receptacle 35 facing upward. The four legs 32 are respectively mounted on four corners of the frame body. Each corner of the periphery of the frame body 34 is formed with a step section 36 which is inward recessed from the top edge. The top edge of the leg 32 is positioned on outer side of the frame body 34, whereby the outer periphery of the frame body 34 forms multiple exposed retaining sections 38. The top edge of the retaining section 38 is lower than the top edge of the frame body 34.

Each of the table bodies 40, 60 is a rectangular frame body with a certain thickness. Two faces of the table body are respectively disposed with two game patterns.

Referring to FIGS. 3 to 6, two faces of the first table body 40 are respectively disposed with a football game face A and a hocket game face B. The football game face A is formed with an inward recessed first space 42. Several rotary bars 43 are passed through two long sides of the first space 42 for rotating dolls 44. A user can operates the dolls 44 to drive a game ball into the goalmouths 45 formed on two short sides of the first space. Then, the game ball will roll through a passage (not shown) formed in the table body to the ball taking openings 46 formed on outer end faces of two short sides of the table body. A user can take out the game ball from the ball taking openings 46 for further playing the game.

The hockey game face B of the table body 40 is formed with a second space 51. Two short sides of the second space 51 are respectively formed with two notch-like wickets 52. Two scorers 53 and two ball collecting boxes 54 are respectively fixedly disposed on two short sides of the table body. The scorer 53 is bridged over the top of the wicket 52 and the ball collecting box 54 is positioned at outer end of the wicket 52. In use, a player holds a driving member (not shown) to drive a circular plate placed on the game face into the wicket 52. The circular plate will then drop into the ball collecting box 54. The player can take out the circular plate from the ball taking hole 55 of the ball collecting box 54 for further playing the game. In addition, the bottom wall 54 of the second space 51 and the interior of the table body 40 is partitioned into a room 56. A blower 57 is fixedly disposed in a short side of the table body 40. The air flow is blown by the blower 57 to flow into the room 56 and flow upward out of the fine vents 58 densely formed on the bottom wall 54. Therefore, the frictional force between the circular plate and the bottom wall 54 is reduced and the circular plate can slide more easily.

Figure 3:
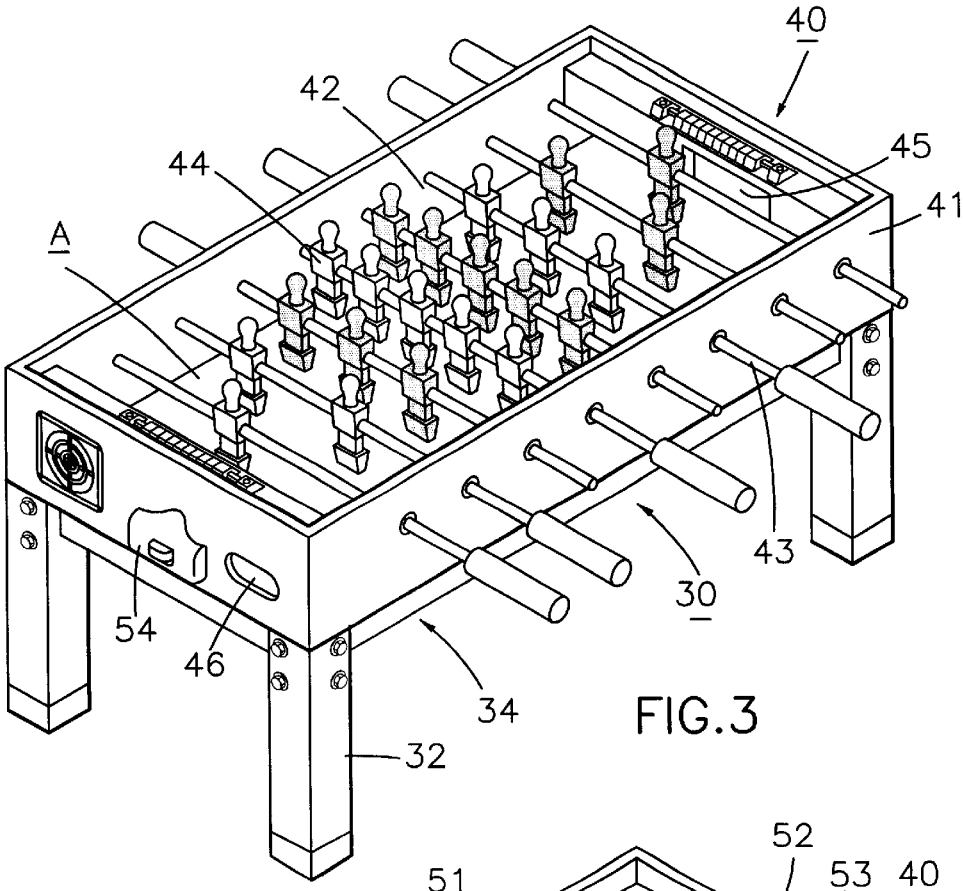
FIG. 3 shows a using state in which the first table body is mounted on the table frame to form a football face.
Figure 6:
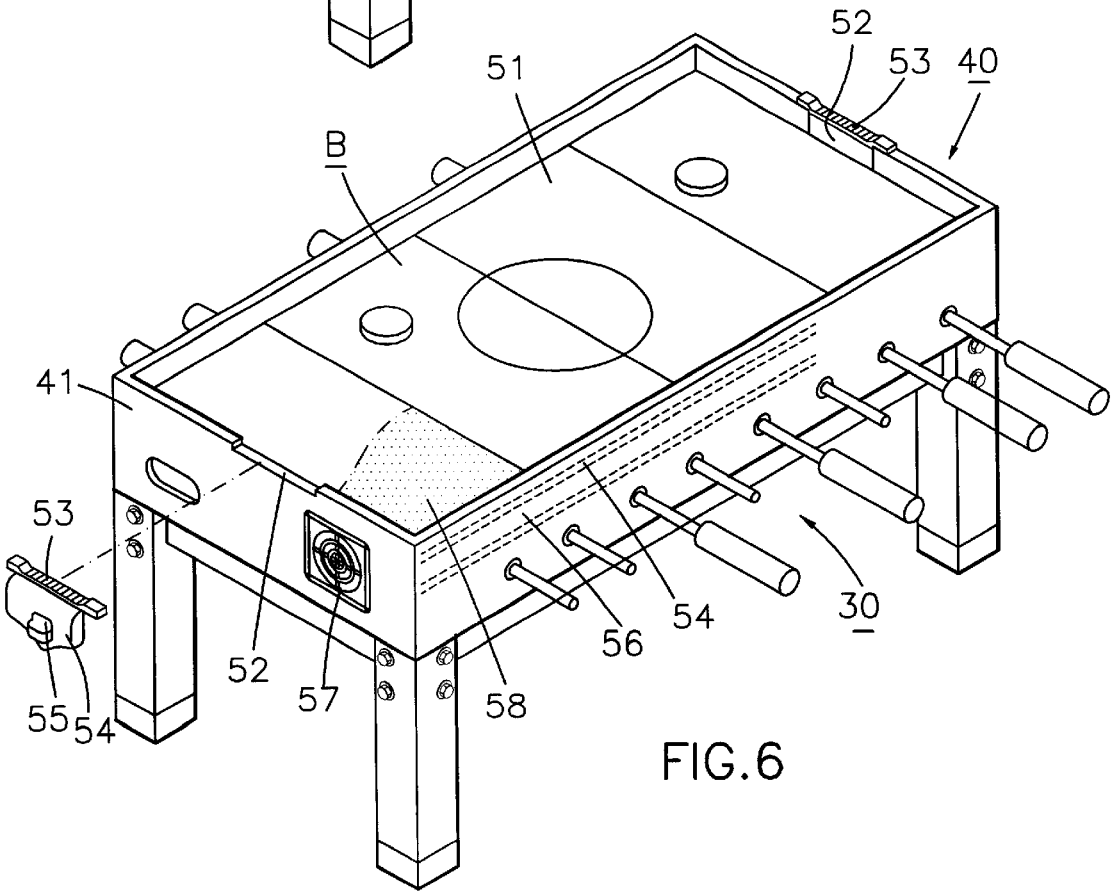
FIG. 6 is similar to FIG. 3, showing a using state of a hockey game face.
Figure 5:
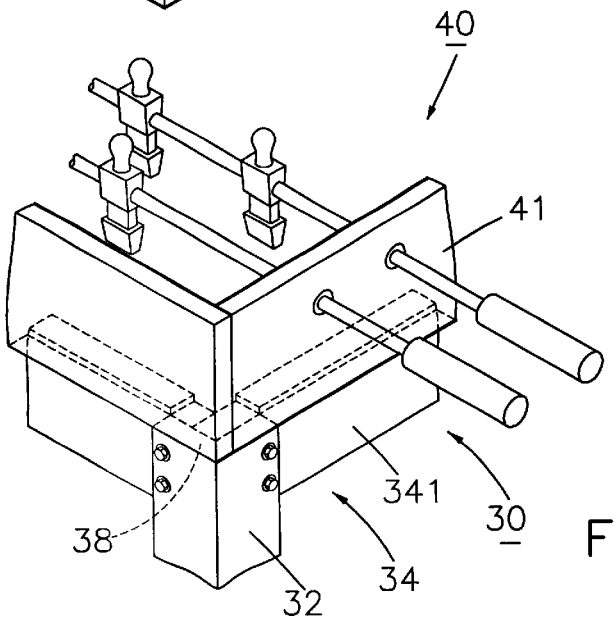
FIG. 5 shows an overlaid state according to FIG. 4.
Figure 7:
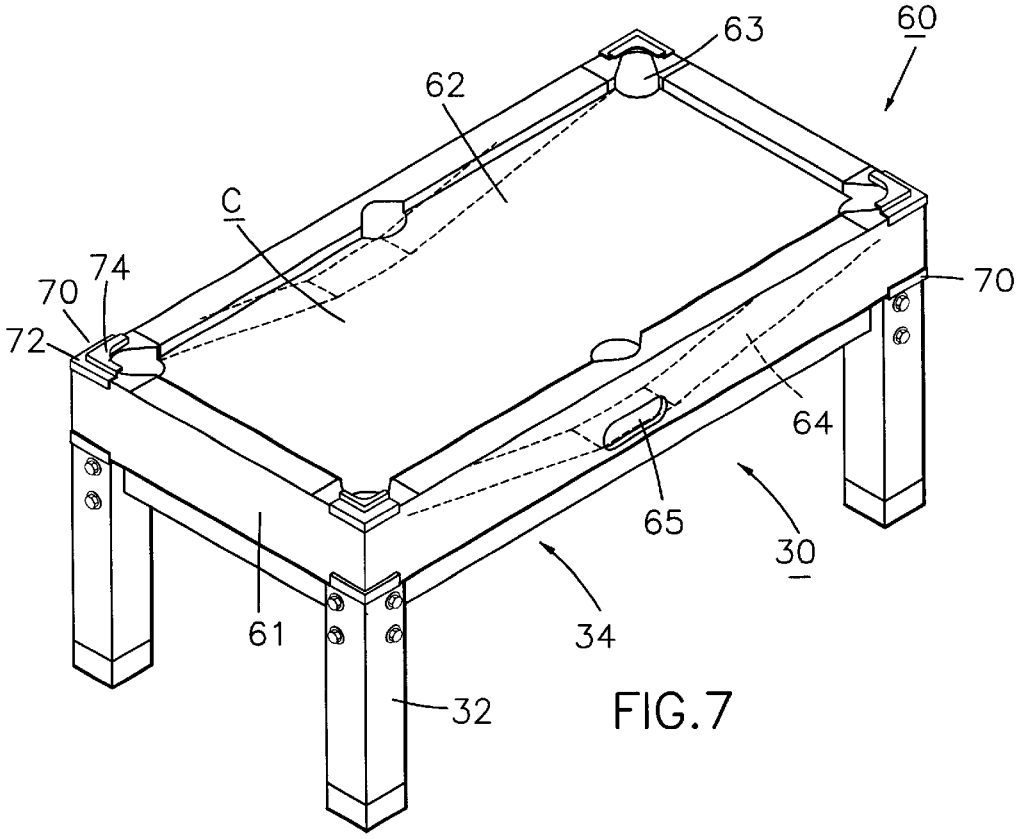
FIG. 7 shows a using state in which the second table body is mounted on the table frame to form a billiards table face.
Figure 8:
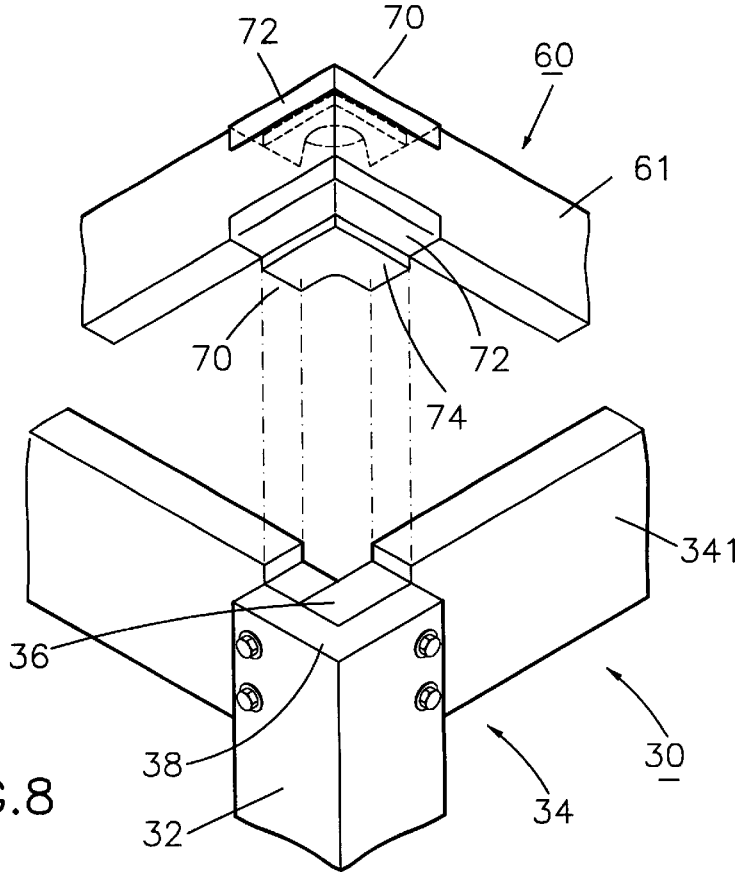
FIG. 8 is a perspective exploded and partially sectional view according to FIG. 7.

The peripheral frame 41 of the table body 40 projects from the top and bottom face thereof. The peripheral frame 41 is fitted onto the frame body 34 of the table frame 30 so as to connect the table body with the table frame as shown in FIG. 5. The bottom edge of the peripheral frame 41 is retained and located by the retaining sections 38 as shown in FIGS. 3 and 6. When playing football game, the table body 40 is fitted on the outer periphery of the table frame 30 with the football game face A facing upward. Reversely, when playing hockey game, the table body is taken down from the table frame and turned upside down to fit with the table frame with the hockey game face B facing upward.

Referring to FIGS. 7 to 10, one face of the second table body 60 is disposed with a billiards game face C, while the other face thereof is a recessed table face D. The billiards game face C is an inward recessed third space 62 for placing ball bodies therein. A player can use a cue to hit the ball bodies into six ball holes 63 formed on four corners and the centers of the long sides of the table face. Each long side of the table body 60 is disposed with an inclined ball way 64 as shown by phantom line. After entering the ball hole 63, the ball body drops into the ball way 64 to roll to a ball taking opening 65 formed at the center of the table body. A player can take out the ball body from the ball taking opening 65 for further playing the game.

Figure 10:
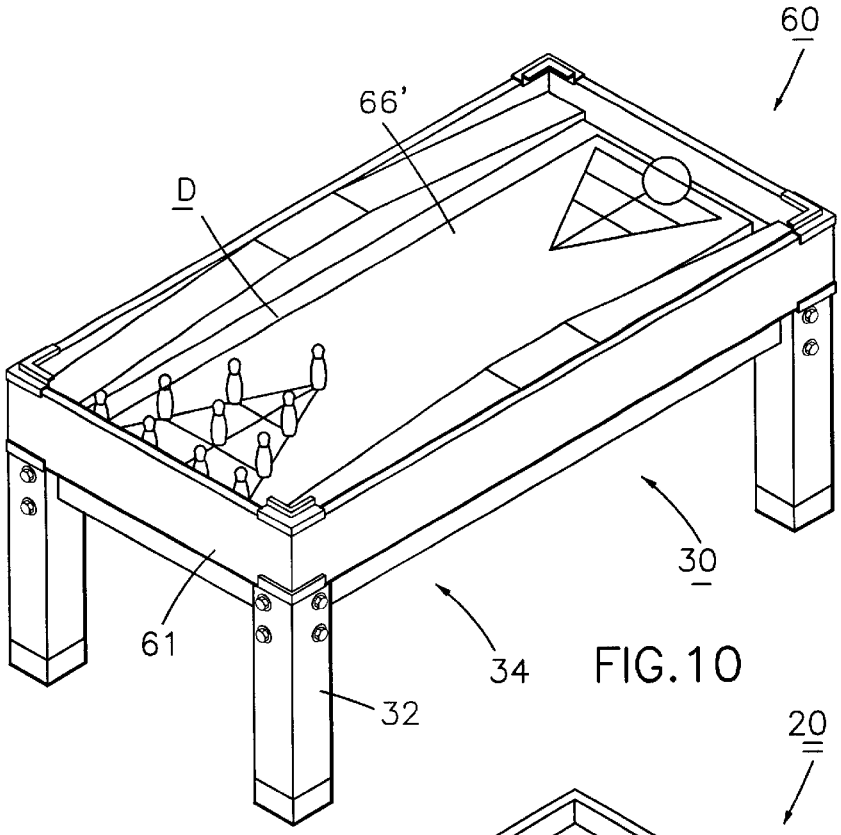
FIG. 10 is a view according to FIG. 7, showing that another sport game is provided.

As shown in FIG. 10, the three panels 66, 66', 66" of FIG. 2 can be placed in the table face D. The faces of the panels are respectively printed with checker, backgammon, shuffleboard and bowling game. When playing a game, a certain panel 66 is placed on the table face for playing the game.

The inner edge of the peripheral frame 61 of the table faces of the table body 60 are disposed with several insertion sections 74 which project outward in a direction normal to the table face. Therefore, the insertion sections 74 protrude outward from the peripheral frame by a predetermined height. The insertion sections are integrally formed on the table body or are mounted on the table body as components. In this embodiment, the table body includes eight insertion members 70. Each insertion member 70 has an L-shaped body 72 and an L-shaped projection upward projecting from the inner edge of the body 72. The projections form the insertion sections 74. The bodies 72 of the insertion members 70 are respectively fixedly disposed on four corners of top and bottom edges of the peripheral frame 61 of the table body, whereby the insertion sections 74 are positioned on inner edge of the peripheral frame 61 and project outward.

Figure 9:
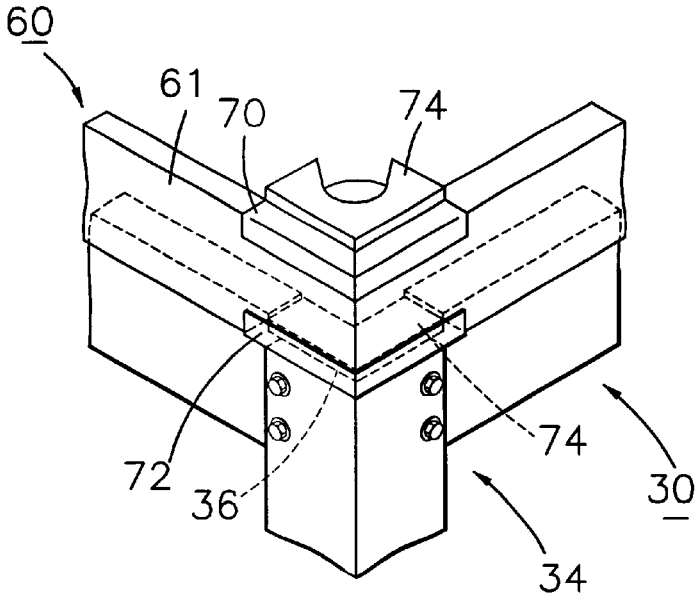
FIG. 9 is a sectional view taken along line 9—9 of FIG. 7.

The table body 60 is overlaid on the table frame 30 and connected therewith. As shown in FIG. 9, when overlaid, the insertion sections 74 of the bottom edge of the peripheral frame 61 are respectively inserted into the step sections 36 and retained thereon, whereby the table body is connected with and located on the table frame. When different table faces are overlaid on the table frame, the games can be interchanged between FIG. 7 and FIG. 10 for playing billiards, checker or bowling.

Figure 11:
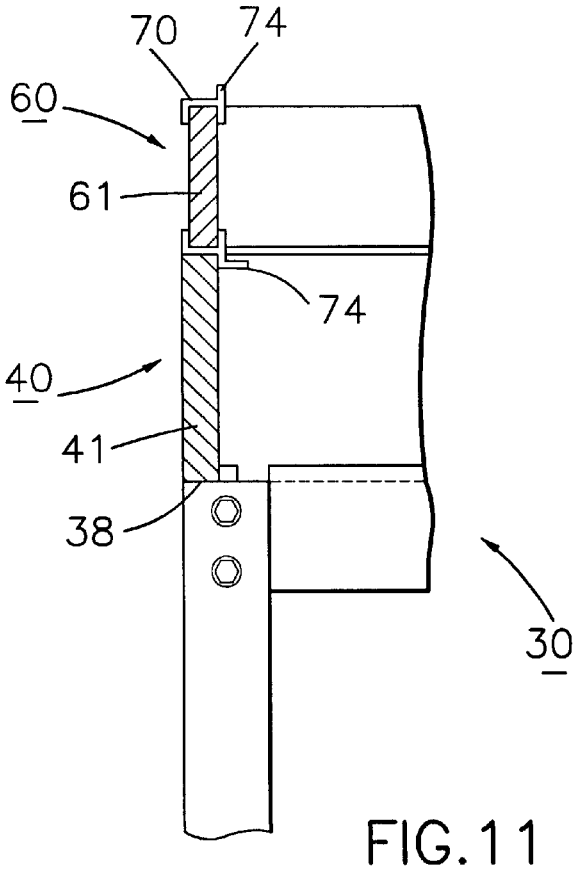
FIG. 11 is a sectional view taken along line 11—11 of FIG. 2, showing that the two table bodies are overlapped.

The two table bodies 40, 60 can be also overlapped with each other. Referring to FIG. 11, when the two table bodies are overlapped, the peripheral frame 61 of the second table body 60 is overlaid on the top edge of the peripheral frame 41 of the first table body 40 and the insertion sections 74 are engaged with the inner wall of the peripheral frame 41 of the first table body. Accordingly, the two table bodies can be interconnected and assembled with each other into a pattern in which the first table body 40 is overlaid on the table frame and the second table body 60 is overlaid on the first table body 40 as shown in FIG. 2. Alternatively, as shown in FIG. 12, the second table body 60 can be underlaid below the first table body 40 to increase the variation.

It should be noted that the insertion sections 74 of the second table body provide hooking and engaging effect so that when the second table body is connected with the table frame, the insertion sections 74 can be engaged with the inner wall of the frame body 34 to locate the second table body. Therefore, it is unnecessary to form any step section 36 on the frame body 34 of the table frame.

Figure 14:
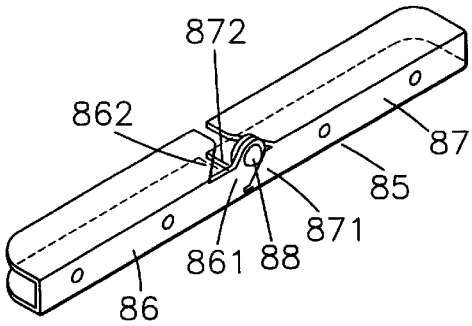
FIG. 14 is a perspective view of the hinge of FIG. 13.
Figure 15:
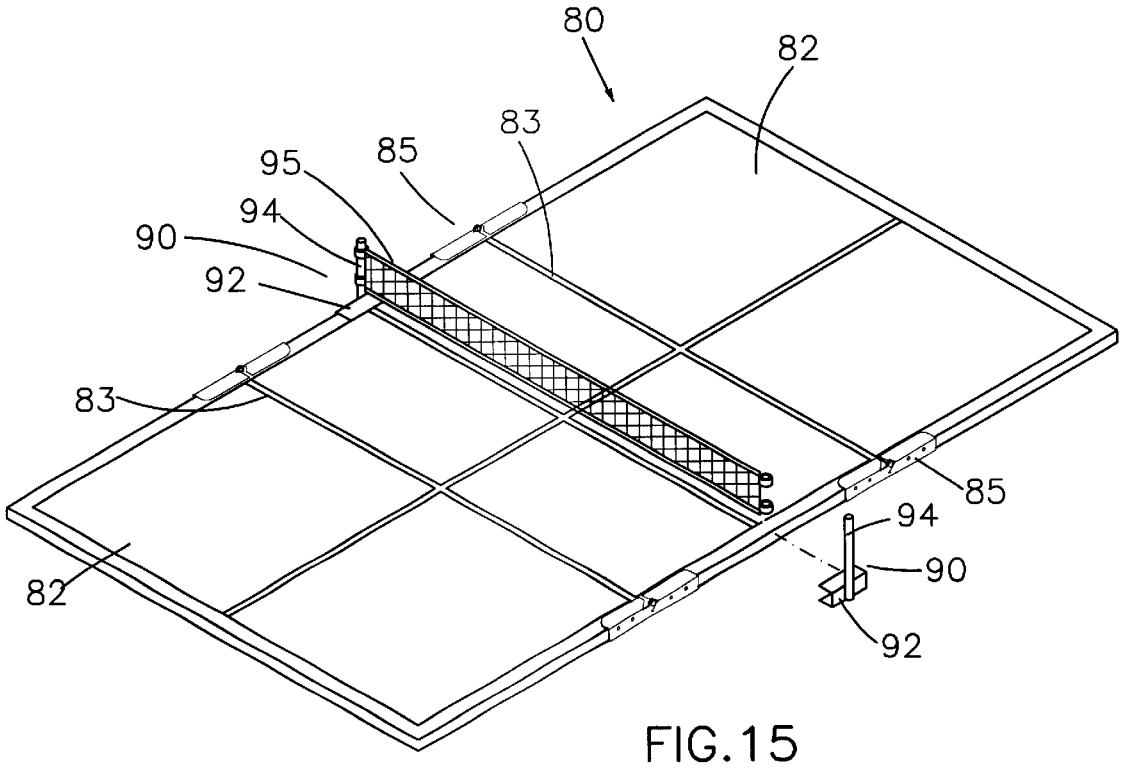
FIG. 15 is a perspective exploded view of the table board of FIG. 13.

This embodiment further includes a rectangular table board 80 as shown in FIGS. 13 to 17. The table board 80 is divided into three board sections 82 along the long axis at equal intervals. Each two adjacent board sections 82 define therebetween a folding line 83 about which the table board can be folded. This embodiment further includes four hinges 85 each having two halves 86, 87. As shown in FIG. 14, each half has a U-shaped cross-section and a pivot section 861, 871 at one end which are pivotally connected about a pivot shaft 88. When the hinge is unfolded, the stop sections 862, 872 disposed at the pivot ends can engage with each other to locate the two halves to contain an angle of 180 degrees. The four hinges 85 are respectively pivotally connected between two adjacent board sections 82. The two halves 86, 87 of each hinge are respectively fixedly connected with one side of a board section 82 with the pivot section aligned with the folding line 83. This embodiment further includes two net supporting members 90 each having a fitting/clamping section 92 with a U-shaped cross-section and a post section 94 upward extending from the fitting/clamping section 92. The fitting/clamping sections 92 of the net supporting members 90 clamp two sides of the middle of the table board 80. Two ends of a net 95 are respectively fitted on the post sections 94.

The face of the table board 80 is marked with certain lines to form a table tennis table face. In use, the table board is unfolded and horizontally placed on the game table 20 as shown in FIG. 13. Then the two net supporting members 90 clamp the table board and the net 95 is fitted with the net supporting member for playing the table tennis.

Figure 16:
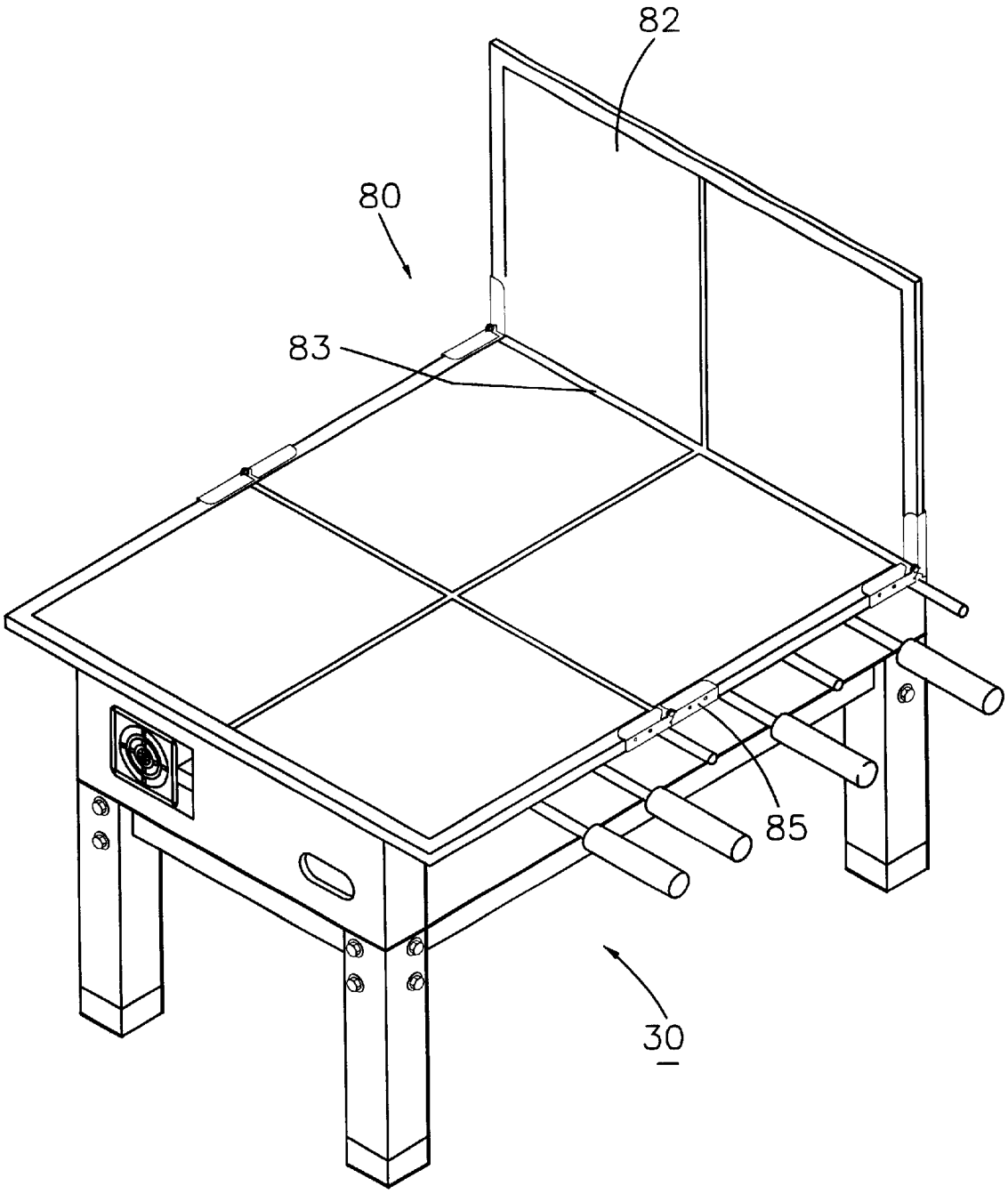
FIG. 16 shows another using state of FIG. 13.

FIG. 13 shows a state in which two players play the table tennis. Alternatively, as shown in FIG. 16, one board section 82 of the table board can be positioned upright to lean against a wall for one single player to practice the table tennis.

Figure 17:
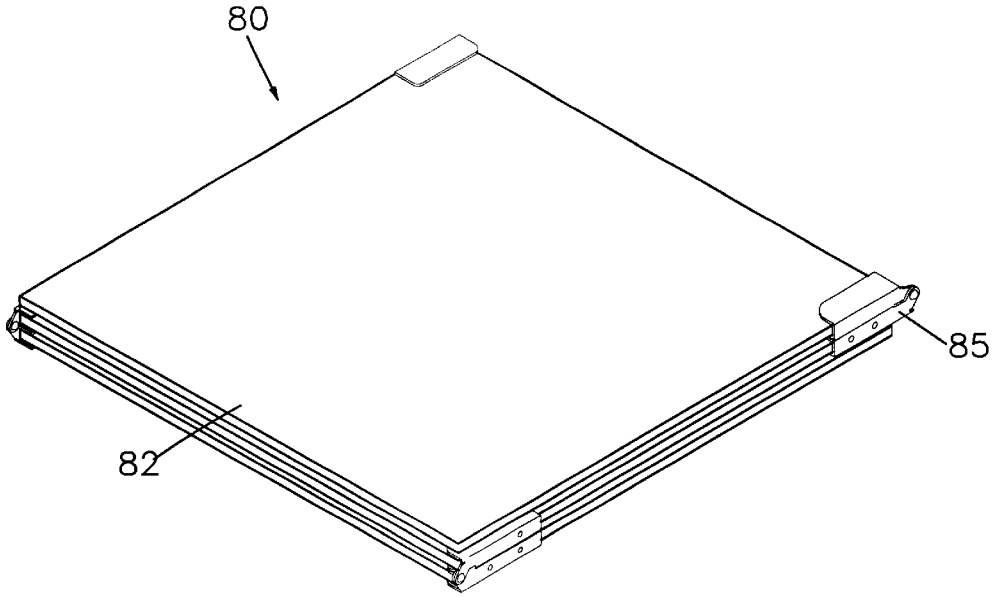
FIG. 17 shows a folded state of the table board.

When not played, the net 95 and the net supporting members 90 are removed from the table board 80 and the board sections 82 are folded about the folding lines 83 as shown in FIG. 17. The folded board body can be stored in the receptacle 35 of the table frame. Similarly, the tools for other games such as cues, ball bodies, the three panels 66, chessmen, bowling balls, bowling pins, driving members and circular plates in hockey game, etc. can be also stored in the receptacle 35 when not used.

Figure 18:
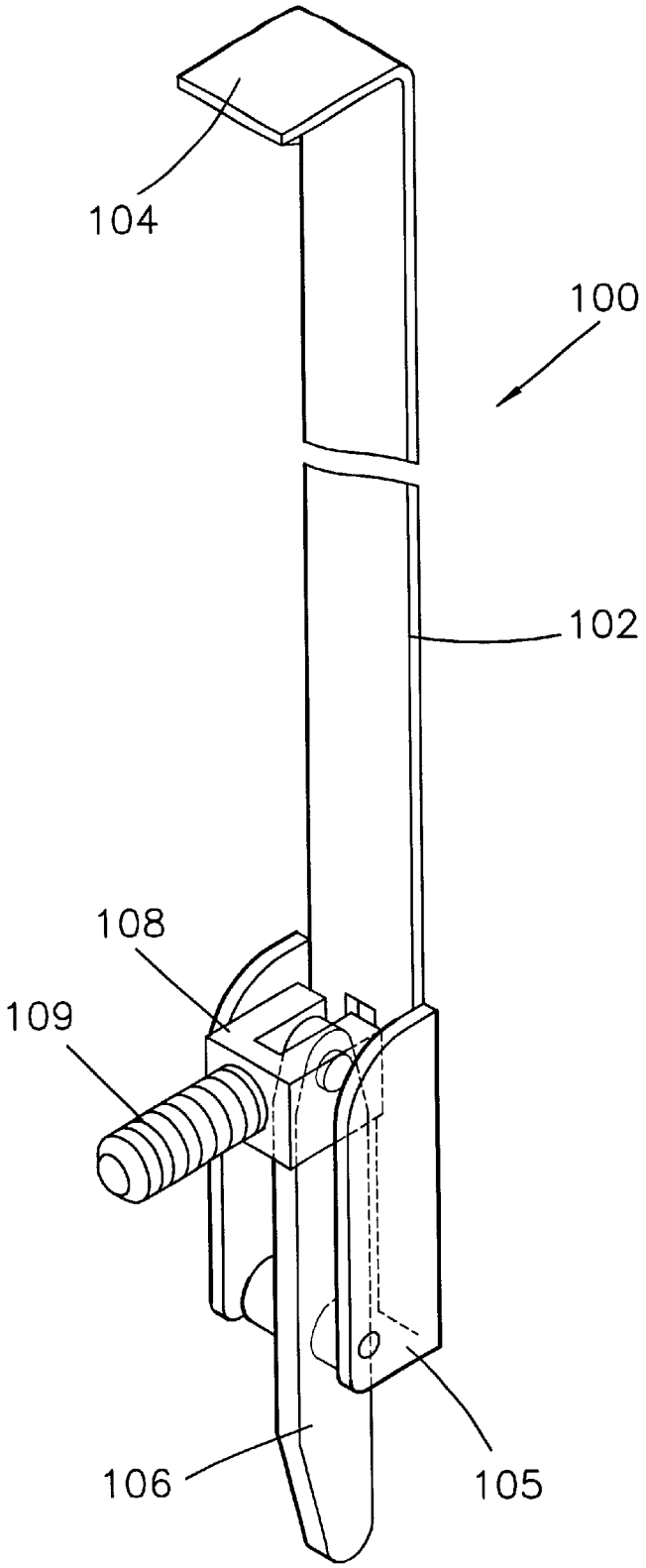
FIG. 18 is a perspective view of a clamping device of the present invention.
Figure 19:
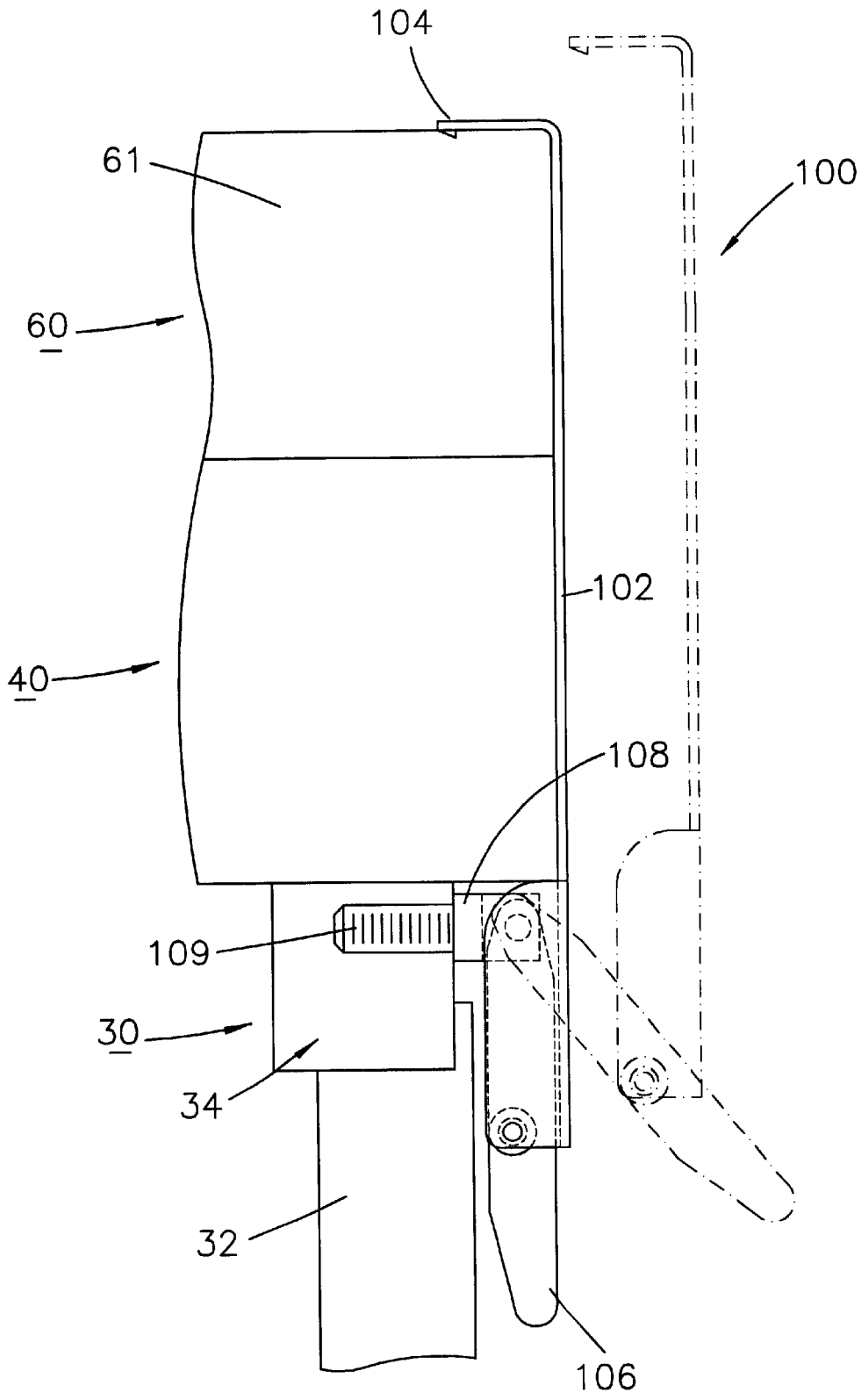
FIG. 19 shows the operation of the clamping device for clamping the game table.

In addition, the present invention further includes a clamping device 100 as shown in FIGS. 18 and 19. The clamping device 100 includes an elongated clamping body 102 having a hook section 104 at top end; a grip 106 having a middle section pivotally connected between two wing sections 105 of bottom end of the clamping body 102; and a fixing body 108 having a thread section 109 at one end. A free end of the fixing body 108 is pivotally connected with the top end of the grip 106. The thread section 109 of the fixing body 108 is screwed into the frame body 34 of the table body 30 as shown in FIG. 19. After the two table bodies 40, 60 are overlaid on the table frame, the bottom end of the grip 106 is shifted downward to drivingly move the clamping body 102 downward and make the hook section 104 hook the top edge of the peripheral frame 61 of the table body 60. Accordingly, the table body is firmly overlaid on the table frame without moving. Reversely, when the bottom end of the grip 106 is upward shifted as shown by the phantom line, the clamping body 102 is drivingly moved upward to disengage the hook section 104 from the table body 60. At this time, the table body can be moved to change the game pattern.

According to the above arrangement, the peripheries of the table frame and the table body can be connected by insertion. Therefore, different table bodies can be variably overlaid on the table frame to provide versatile games. Moreover, the table body is overlaid on the table body without limitation of thickness of the table body. Therefore, various game patterns can be designed on the table body such as the football, billiards with ball ways and hockey with blowing air.

The above embodiments are only used to illustrate the present invention, not intended to limit the scope thereof. Many modifications of the above embodiments can be made without departing from the spirit of the present invention.

What is claimed is:

1. A game table with a table body overlaid on and connected with a table frame, comprising:

a table frame having a rectangular frame body and a predetermined number of legs connected to the frame body wherein an outer periphery of the frame body has a predetermined number of exposed retaining sections; and at least one first table body which is a rectangular frame body with a thickness and horizontally positioned, a top face and a bottom face of the first table body having different game patterns, the first table body being overlaid on the table frame with one of the top and bottom faces facing upwardly, a bottom edge of a peripheral frame of the first table body being engaged with a top edge of a peripheral frame of the frame body of the table frame, the peripheral frame of the first table body protruding from the top and bottom faces of the first table body by a predetermined height, the peripheral frame of the first table body being fitted with the outer periphery of the frame body, the bottom edge of the peripheral frame being engaged with the top edges of the retaining sections, whereby the first table body is positioned vertically above the table frame, whereby a player can overlay the table body on the table frame with either of the top and bottom faces facing upwardly or take off the table body from the table frame.

2. The game table as claimed in claim 1, wherein top edges of the legs are positioned on an outer side of the frame body to form the retaining section.

3. The game table as claimed in claim 1, wherein a periphery of the peripheral frame of any of the faces of the first table body has a plurality of insertion sections, each insertion section vertically outwardly protruding from the peripheral frame by a predetermined height, horizontally, each insertion section and the adjacent peripheral frame having a level drop, whereby when the table body is overlaid on the table frame, the bottom edge of the peripheral frame of the table body is overlapped with the top edge of the peripheral frame of the frame body and the insertion sections are inserted in the periphery of the peripheral frame of the frame body.

4. The game table as claimed in claim 1, wherein a periphery of the peripheral frame of the frame body of the table frame has a plurality of insertion sections, each insertion section vertically outwardly protruding from the peripheral frame by a predetermined height, horizontally, each insertion section and the adjacent peripheral frame having a level drop, whereby when the table body is overlaid on the table frame, the bottom edge of the peripheral frame of the table body is overlapped with the top edge of the peripheral frame of the frame body and the insertion sections are inserted in the periphery of the peripheral frame of the table body.

5. The game table as claimed in claim 3, wherein the insertion sections are positioned on an inner side of the peripheral frame of the first table body, whereby when the first table body is overlaid on the table frame, the insertion sections are inserted in an inner wall of the peripheral frame of the frame body.

6. The game table as claimed in claim 5, wherein the first table body further includes a predetermined number of insertion members each having a body, each insertion section being connected with a periphery of the body and outwardly protruding from the body of the insertion member, the body of the insertion member being fixedly connected with the peripheral frames of the top and bottom faces of the table body with the insertion section positioned on an inner side of the peripheral frame.

7. The game table as claimed in claim 3, wherein the insertion sections are positioned on an outer side of the peripheral frame of the first table body, whereby when the first table body is overlaid on the table frame, the insertion sections are inserted in an outer wall of the peripheral frame of the frame body.

8. The game table as claimed in claim 1, further comprising at least one second table body which is a rectangular frame body with a thickness and horizontally positioned, top and bottom faces of the second table body having different game patterns, a periphery of a peripheral frame of any of the faces of the second table body having a plurality of insertion sections, the second table body being overlaid on the frame body of the table frame, whereby the second table body is positioned at a height vertically above the table frame, the insertion sections being inserted in the peripheral frame of the frame body, the second table body being able to be vertically overlapped with the first table body with the insertion sections inserted in the periphery of the peripheral frame of the first table body, whereby only the first table body is overlaid on the table frame or only the second table body is overlaid on the table frame or the first and second table bodies are both overlaid on the table frame with the first table body overlaid on the second table body or the first and second table bodies are both overlaid on the table frame with the second table body overlaid on the first table body.

9. The game table as claimed in claim 8, wherein each insertion section vertically outwardly protrudes from the peripheral frame of the second table body by a predetermined height and horizontally, each insertion section and the adjacent peripheral frame have a level drop.

10. The game table as claimed in claim 9, wherein the insertion sections are positioned on an inner side of the peripheral frame of the table body, whereby when the second table body is overlaid on the table frame or the first table body, the insertion sections are inserted in the inner wall of the peripheral frame of the frame body or the inner wall of the peripheral frame of the first table body.

11. The game table as claimed in claim 9, wherein the insertion sections are positioned on an outer side of the peripheral frame of the table body, whereby when the second table body is overlaid on the table frame or the first table body, the insertion sections are inserted in the outer wall of the peripheral frame of the frame body or the outer wall of the peripheral frame of the first table body.

12. The game table as claimed in claim 1, wherein peripheries of the peripheral frame of the faces of the first table body have a plurality of outward projecting insertion sections, the top edge of the frame body of the table frame being formed with several step sections the number of which is equal to that of the insertion sections, whereby when the table body is overlaid on the table frame, the insertion sections are respectively inserted into the step sections.

13. The game table as claimed in claim 1, wherein:

the top edge of the frame body of the table frame is formed with a step section on each corner, the legs being respectively connected with the four corners of the frame body, the top edges of the legs being positioned on outer side of the frame body, whereby the outer periphery of the frame body forms multiple exposed retaining sections, the top edges of the retaining sections being lower than the top edge of the frame body; and the peripheral frame of the first table body outward protrudes from the top and bottom faces of the table body by a certain height, whereby when the table body is overlaid on the table frame, the peripheral frame of the table body is fitted on outer periphery of the frame body with the bottom edge of the peripheral frame engaged with the retaining sections, said game table further comprising at least one second table body which is a rectangular frame body with a certain thickness and horizontally positioned, a top and a bottom faces of the second table body being respectively disposed with different game patterns, the four corners of the peripheral frame of any of the faces of the second table body being respectively disposed with an insertion section, the insertion section outward protruding from the peripheral frame by a certain height, the second table body being overlaid on the frame body of the table frame, whereby the table body is positioned at a height vertically above the table frame, the insertion sections being inserted in the step sections, the second table body being able to be vertically overlapped with the first table body with the insertion sections inserted in the inner wall of the peripheral frame of the first table body.

14. The game table as claimed in claim 13, further comprising eight insertion members each having an L-shaped body and an L-shaped insertion section disposed on inner edge of the body at a height higher than the body, the insertion members being respectively disposed on the corners of the top and bottom faces of the table body.

15. The game table as claimed in claim 1, further comprising a rectangular table board which is divided into at least two board sections along the long axis at equal intervals, each two adjacent board sections defining therebetween a folding line about which the table board can be folded, when unfolded, the table board being horizontally placed on the game table for use.

16. The game table as claimed in claim 15, wherein the table board further includes a predetermined number of hinges respectively disposed between each two adjacent board sections in alignment with the folding lines.

17. The game table as claimed in claim 16, wherein each hinge has two halves, each half having a U-shaped cross-section, one end of each half being disposed with a stop section, the ends of the halves with the stop sections being pivotally connected with each other, whereby when the hinge is unfolded, the stop sections engage with each other, the two halves of each hinge clamping outer sides of the board sections.

18. The game table as claimed in claim 15, wherein the table board further includes: two net supporting members each having a fitting/clamping sections with a U-shaped cross-section and a post section upward extending from the fitting/clamping section, the fitting/clamping sections of the net supporting members clamping two sides of the table board; and a net two ends of which are fitted on the post sections.

19. The game table as claimed in claim 1, further comprising a predetermined number of panels, a face of each of the panels being marked with certain lines, whereby the panel can be placed on the game table for use.

20. The game table as claimed in claim 1, further comprising a clamping device including: an elongated clamping body having a hook section at top end; a grip having a middle section pivotally connected between two wing sections of bottom end of the clamping body; and a fixing body one end of which is pivotally connected with the top end of the grip under the hook section, the other end of the fixing body being fixedly connected with the table frame, whereby when the bottom end of the grip is shifted downward, the clamping body is synchronously drivingly moved downward to make the hook section hook the top edge of the table body.

* * * * *